US009536391B2

(12) United States Patent
Pececnik

(10) Patent No.: US 9,536,391 B2
(45) Date of Patent: Jan. 3, 2017

(54) AWARD INDICATOR FOR ECONOMIC GAMING ACTIVITY

(71) Applicant: Joze Pececnik, Smarca (SI)

(72) Inventor: Joze Pececnik, Smarca (SI)

( * ) Notice: Subject to any disclaimer, the term of this patent is extended or adjusted under 35 U.S.C. 154(b) by 516 days.

(21) Appl. No.: 13/931,801

(22) Filed: Jun. 28, 2013

(65) Prior Publication Data

US 2015/0005053 A1 Jan. 1, 2015

(51) Int. Cl.
*G07F 17/32* (2006.01)

(52) U.S. Cl.
CPC ..... *G07F 17/3255* (2013.01); *G07F 17/3223* (2013.01)

(58) Field of Classification Search
CPC ..... G07F 17/3223; G07F 17/3211; G07F 17/3255
USPC ..... 463/25, 42
See application file for complete search history.

(56) References Cited

U.S. PATENT DOCUMENTS 3,822,496 A 7/1974 Minder
3,927,484 A 12/1975 Spiegel et al.
3,958,354 A 5/1976 Hough et al.
4,559,729 A 12/1985 White
4,911,320 A 3/1990 Howes
5,007,578 A 4/1991 Simone
5,076,433 A 12/1991 Howes
5,588,649 A * 12/1996 Blumberg ..... A63F 3/081 463/18
5,806,852 A 9/1998 Howes
5,865,470 A * 2/1999 Thompson ..... B42D 15/00 283/51
6,085,919 A 7/2000 Singer
8,346,210 B2 1/2013 Balsan et al.
8,368,515 B2 2/2013 Kim
8,370,629 B1 2/2013 Ngo et al.
8,373,429 B2 2/2013 Slupsky et al.
8,374,546 B2 2/2013 Maugars et al.
(Continued)

OTHER PUBLICATIONS

McDonald's "Monopoly Game", Trademark 1999, "Game starts on or about Mar. 6, 1997".*

*Primary Examiner* — Michael Cuff
(74) *Attorney, Agent, or Firm* — Mark. A. Litman & Associates, P.A.

(57) ABSTRACT

A system and method obtains random award-content information on an economic entity associated with a gaming establishment. The system has an award identifier selected from the group consisting of an article or purchase receipt intimately associated with an electromagnetically functional such as a hand-held information receiving and transmission device that can interrogate the award identifier. The award identifier contains communicable information relating to a random value that can be used for wagering credit in the gaming establishment. A distal server is in wireless two-way communication with the intermediate system entry device, the distal server capable of receiving, storing and transmitting information from the award identifier transmitted through the intermediate system entry device. Information specific to at least available gaming value available through the intermediate system entry device is identified only after communication has been first established between the intermediate system entry device and the server.

20 Claims, 3 Drawing Sheets

(56) References Cited

U.S. PATENT DOCUMENTS

| | | | | |
|---|---|---|---|---|
| 2002/0130511 | A1* | 9/2002 | Thompson | B42D 15/045 283/81 |
| 2003/0186739 | A1* | 10/2003 | Paulsen | G07F 17/32 463/25 |
| 2005/0021940 | A1* | 1/2005 | Ma | H04W 12/06 713/155 |
| 2006/0217174 | A1* | 9/2006 | Walker | G07F 17/32 463/16 |
| 2008/0051193 | A1* | 2/2008 | Kaminkow | G06Q 20/3433 463/25 |
| 2009/0098921 | A1* | 4/2009 | Manning | G06Q 20/3224 463/17 |
| 2009/0276304 | A1* | 11/2009 | Dorr | G06Q 20/20 705/14.14 |
| 2010/0227670 | A1* | 9/2010 | Arezina | G07F 17/32 463/25 |

* cited by examiner

FIGURE 2

HAND-HELD DEVICE OF KIOSK INTERROGATES CODE OR CHIP ON ARTICLE OR RECEIPT (VALUE IDENTIFIER)

↓

READABLE INFORMATION RECEIVED BY DEVICE OR KIOSK AND TRANSMITTED TO SERVER

↓

SERVER IDENTIFIES RANDOM AMOUNT OF VALUE, ESPECIALLY WAGERING VALUE ASSOCIATED WITH VALUE IDENTIFIER

↓

RANDOM AMOUNT OF VALUE INDICATED TO USER OF HAND-HELD DEVICE OR KIOSK

↓

USER APPLIES INDICATED VALUE TO WAGER

AWARD INDICATOR FOR ECONOMIC GAMING ACTIVITY

BACKGROUND OF THE INVENTION

1. Field of the Invention

The present technology relates to accessible content from electronic chips, scannable input, electronically/visually accessible content that communicate through video take-up, near field or far field communication links, on hand-held devices or kiosk devices that sense and communicate with the chip or scannable input, and hand-held devices that communicate with a distal server to store and broadcast information comprising at least virtual game value awarded. The accessible content may also be used as a marketing tool within a gaming establishment or environment.

2. Background of the Art

Involving a combination of contactless identification and networking technologies, near field communication (NFC) is a wireless connectivity technology that enables convenient short-range communication between electronic devices. NFC is a very short-range wireless technology, for distances measured in centimeters, and is optimized for intuitive, easy and secure communication between various devices without user configuration. In order to make two devices communicate, users bring them close together or even make them touch. The devices' NFC interfaces will automatically connect and configure themselves to form a peer to peer network.

A further application of NFC is the combination of NFC applications with smart card security concept so that devices act like contactless smart cart with cryptographic capabilities. This NFC technology can be denoted as secure NFC and is standardized in ISO 18092, ECMA 340 and ECGS 102190. NFC is also compatible to the broadly established contactless smart card infrastructure based on ISO 14443 A.

The secure NFC can be included in wireless mobile communication devices like mobile phones, PDAs and the like. This means that confidential data and data that represents values is stored in a secure memory area and always stays on the mobile communication device. An authentication is performed by the secure NFC functionality included, for example, in a PDA or mobile phone and transmitted data can be encrypted by the secure NFC functionality using a private encryption key stored on the mobile phone.

The implementation of the secure NFC functionality into a wireless mobile communication device like a mobile phone allows the application of the mobile phone as for example a virtual stored transport ticket or an access key to a building (home or office), wherein the ticket or the access key is transferred by the secure NFC functionality of the mobile phone for granting the access to a transport means or a building.

Wireless mobile communication devices generally have to be equipped with autonomous energy sources due to their mobile character. U.S. Pat. No. 8,374,546 enables a secure NFC device with multiple energy sources.

U.S. Pat. No. 8,370,629 (Ngo) describes a system and method for determining and sharing of trusted location data. The system includes a network device or application and at least two independent trusted sources of location data/location assistance data, where the at least two independent trusted sources have unique and unalterable ID codes. The network device or application receive and authenticate the location information/location assistance data from the at least two independent trusted sources, and the network device or application calculates a trusted location estimate by comparing the location data of the at least two independent trusted sources. The network device or application is a self-aware device. The trusted location data may be virally shared with other self-aware network devices in the network.

U.S. Pat. No. 8,373,429 (Slupsky) describes a sensing system using RF technology with chips to interrogate information for location of or content of articles. The method and apparatus interrogates an electronic component, and includes a body having an interface for an interrogating device to use as a conduit in reliably performing multiple discrete interrogations of the electronic component without the interrogating device physically touching the electronic component (e.g., near field communication).

U.S. Pat. Nos. 5,806,852, 5,076,433, and 4,911,320 (Howes) shows that by constructing an actual product in a distinctive and readily identifiable manner (including wrappers and elements associated with purchased goods) and distributing the uniquely constructed product with conventional products, a unique prize winning notifier or indicator for a promotional contest is realized. Preferably, each prize notifying or indicating product is manufactured as an actual, individual product, using generally conventional production method, and comprises a unique, distinguishable, feature or characteristic which designates such products as prize winners. As a result, prize identifying products are packaged and sold in direct association with non-prize related products, without any degradation, contamination, or other difficulties as previously encountered with prior art systems or promotional vehicles.

U.S. Pat. No. 8,368,515 enables an RFID device, and more particularly to a RFID device which can be used in both a tag mode and a reader mode. There is provided an RF antenna transmitting and receiving wireless signals; a tuning circuit as a frequency filtering circuit connected to the RF antenna; a memory storing data; and a wireless communication card including antenna connection terminals connected to the RF antenna.

U.S. Pat. No. 8,346,210 (Belsan) enables the use of tags for global positioning of services and the like. One or more services are managed corresponding to a bearer tag (e.g., near field communication (NFC) tag, radio frequency identification (RFID) tag, contactless card, or barcode). A request to manage a service is initiated by reading service information from a bearer tag corresponding to the one or more services. A services platform initiates management of the one or more services based on the service information according to a predetermined or recurring billing arrangement.

Other systems with prizes awarded on labels or stickers on purchased articles include U.S. Pat. No. 5,007,578 (Simone); U.S. Pat. No. 6,085,919 (Singer); U.S. Pat. No. 3,958,354 (Hough); U.S. Pat. No. 3,822,496 (Minder); U.S. Pat. No. 3,927,484 (Spiegel); and U.S. Pat. No. 4,449,729 (White).

All references cited herein are incorporated by reference in their entirety.

The present invention is directed towards moving wireless technology into a marketing and integrated gaming facilitating system useful in a gaming environment.

SUMMARY OF THE INVENTION

A system and method obtains and transmits and stores random award-content information on an economic entity associated with a gaming establishment. The system may have:

an award identifier selected from the group consisting of an article or purchase receipt intimately associated with an electromagnetically interrogatable code;

an intermediate system entry device selected from the group consisting of a hand-held information receiving and transmitting device or kiosk information receiving and transmission device that can interrogate the award identifier, the intermediate entry device comprising a camera, a scanner, RFID reader and/or NFC reader to electromagnetically interrogate the award identifier;

the award identifier containing communicable information relating to a random value that can be used for wagering credit in the gaming establishment;

a distal server in wireless two-way communication with the intermediate system entry device, the distal server capable of receiving, storing and transmitting information from the award identifier transmitted through the intermediate system entry device;

wherein upon interrogation of the award identifier by the intermediate system entry device, the intermediate system entry device communicates data received in response from the interrogation of the award identifier to the server, the server containing information in memory that is transmitted to and received by the intermediate system entry device, wherein the information contained in memory comprises information specific to at least available gaming value available through the intermediate system entry device only after communication has been first established between the intermediate system entry device and the server.

BRIEF DESCRIPTION OF THE FIGURES

FIG. 2 shows a flow diagram in which a process according to the present technology is performed.

DETAILED DESCRIPTION OF THE INVENTION

Figure 1:
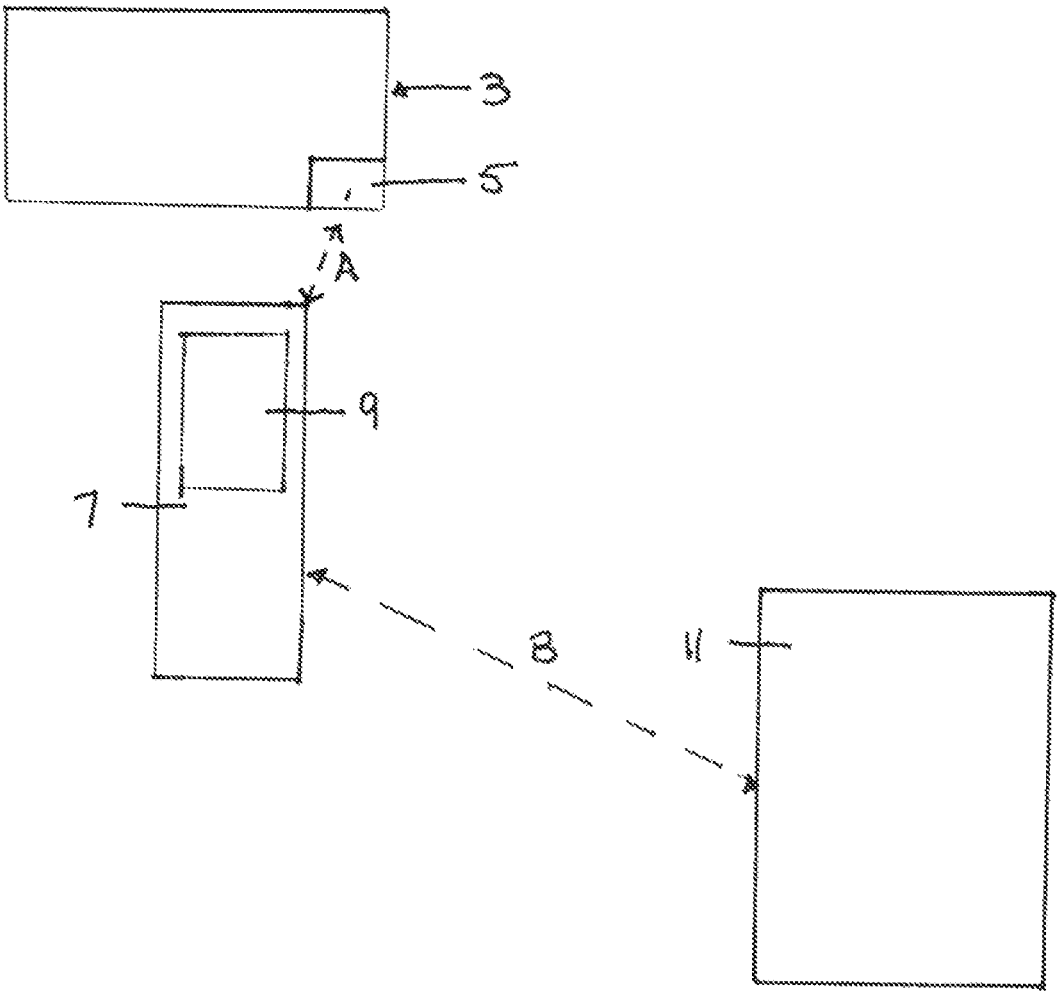
FIG. 1 is a schematic of a system according to the present technology.

A system and method obtains and transmits and stores random award-content information on an economic entity associated with a gaming establishment. The system may have:

an award identifier selected from the group consisting of an article or purchase receipt intimately associated with an electromagnetically interrogatable code;

an intermediate system entry device selected from the group consisting of a hand-held information receiving and transmitting device or kiosk information receiving and transmission device that can interrogate the award identifier, the intermediate entry device comprising a camera, a scanner, RFID reader and/or NFC reader to electromagnetically interrogate the award identifier;

the award identifier containing communicable information relating to a random value that can be used for wagering credit in the gaming establishment;

a distal server in wireless two-way communication with the intermediate system entry device, the distal server capable of receiving, storing and transmitting information from the award identifier transmitted through the intermediate system entry device;

wherein upon interrogation of the award identifier by the intermediate system entry device, the intermediate system entry device communicates data received in response from the interrogation of the award identifier to the server, the server containing information in memory that is transmitted to and received by the intermediate system entry device, wherein the information contained in memory comprises information specific to at least available gaming value available through the intermediate system entry device only after communication has been first established between the intermediate system entry device and the server.

The system may be structured wherein the award identifier is, by way of non-limiting examples, a camera readable or scannable QR code, a camera readable or scannable bar code, a chip, a transceiver or a transponder providing a connectable address to an interactive program on the server relating to the availability of a random value that can be used for wagering credit in the gaming establishment. Unique codes for each article or receipt may be provided for security to assure that code entry is not repeatedly entered into the system. Losing (non-winning codes) may be repeated without concern. The system may use (for example) a hand-held device and the hand-held device is configured to interrogate the QR code, bar code, chip, transceiver or transponder and accept information from the award identifier through near-field communication, and is also configured to transmit and receive information to the distal server by wireless communication. For example, the wireless communication between the hand-held device and the distal server may be enabled through long-range electromagnetic communication systems, such as a radio frequency communication system.

There may be visual information (or shielded transducer, chip or transceiver) provided in a location visually (or electromagnetically) inaccessible by a person holding the hand-held device and the award identifier, and the award identifier is associated with an article in a manner such that the award identifier cannot be identified until packing around the article has been opened or the award identifier has been removed from the article. Similarly, the system may have visual information provided in a location visually accessible by a person positioning the award identifier with respect to the kiosk, and the award identifier is associated with an article in a manner such that the award identifier cannot be identified until packing around the article has been opened or the award identifier has been removed from the article. The server may be, by way of non-limiting examples, a host gaming server configured to account for wagering credits at gaming equipment in a gaming environment or a central account server for a gaming facility. The server may be a host gaming server configured to account for wagering credits at gaming equipment in a gaming environment, and the server may transmit machine-readable code for display on the hand-held device which can be further interrogated at a gaming device to provide wagering value at that gaming device or in a gaming system in communication with that gaming device. Wherein the intermediate system entry device is a kiosk, the kiosk may be configured to issue tickets (in a ticket-in-ticket-out modality, as well known in the gaming art) that can be read by gaming devices to indicate available wagering value.

A method of using the system described herein may include a hand-held device interrogating a QR code, a bar code, interrogatable chip, transceiver or transponder on a specific article and receiving information from the interrogatable code, chip, transceiver or transponder in near-field communication or visually captured information; the received information is then transmitted to the distal server by wireless transmission and is then stored in memory at the distal server, the received information comprising at least a code associated with a gaming value stored in memory in the distal server, the distal server then enabling use of that gaming value by communication from the hand-held device to a gaming device. Wherein a kiosk interrogates a QR code, interrogatable chip, transceiver or transponder on a specific article and receives information from the interrogatable chip, transceiver or transponder in near-field communication or visually captured information; the received information is then transmitted to the distal server by wireless transmission and is then stored in memory at the distal server, the received information comprising at least a code associated with a gaming value stored in memory in the distal server, the distal server then enabling use of that gaming value by, for example, the kiosk printing a machine readable ticket identifying an amount of gaming value available from use of the ticket or transmitting the information to a hand-held device. The distal server may provide to the hand-held device, in addition to gaming value, a menu of additional information available with respect to the specific economic transaction or related economic transactions at the gaming establishment, such as comps at dining facilities or discounts at shows at the gaming facility. The hand-held device may interrogate the award identifier to access information on random gaming value specifically associated with unique identification content on the article. The location may be an enclosed gaming facility and the award identifier is visual information provided in a location visually accessible by a person positioning the award identifier with respect to the kiosk, and the award identifier is associated with an article in a manner such that the award identifier cannot be identified until packing around the article has been opened or the award identifier has been removed from the article. The article may be a physical article (clothing, incidentals, jewelry, furniture, apparel, and the like) and a tag or clip thereon is removed to expose and enable interrogation of content on the tag or clip. The award identifier may also be a receipt for a purchase made (e.g., for shows, a meal, trips, articles purchased, and the like).

The amount of the wager value (which may also be a general value applicable only to economic transactions within facilities associated with the gaming environment) should be randomly applied, although it might be a fixed amount of the purchase, with the fixed amounts varying among different classes of purchases. For example, margins are very small for stores and casinos in the purchase of magazines or gum, and so low fixed percentages (e.g., 0.01%-0.05%) might apply. With higher margin items such as high end designer clothing, higher fixed percentages (e.g., 0.1 to 0.5% net sales price) may be applied. The random selection of absolute wagering value or percentages (as the measure of wagering value) is a preferred method.

The general system for performing this technology may include at least: an economic event or potential economic transaction associated with an electromagnetically interrogatable award indicator. The event may be a purchase of an article, a ticket, a service, a wager at a casino, food, etc. In the casino environment, for example, multiple wagering events are often occurring at the same time. There may be multiple sports events, each with differing wagering options available at any time. For example, there may be keno games, bingo games, lotteries, football games, basketball games and baseball games occurring at the same time. It would be difficult for a single player at a single location to navigate his way through all of the events from a single location to place the wagers. By having a player (and player hand-held device) authenticated at a player position (e.g., a private cubicle or booth) and having a unique award indicator or award identifier at that physical location, the player can view the multiple available visual display screens, access the drop-down field of use list through the award identifier at, navigate through the available wagers associated with the multiple display screens, and place a wager through the hand-held device using the randomly awarded credits or value.

There may be a hand-held information receiving and transmitting device that can interrogate the award identifier, the hand-held information receiving and transmitting device comprising a camera, RFID and/or NFC reader to electromagnetically interrogate the readable code or data. The technical aspects and content of the award identifier are described in greater detail later herein.

The award identifier may also contain communicable information relating to a temporary location of a hand-held information receiving and transmitting device. By the term "location" in this specific activity, actual physical location is not always necessarily essential. What is referred to is location as a point of reference within a communication network and accessing the possible location of an available transaction or economic event or specific article purchased. Except in reference to the entire environment of the visual display systems or the accessing of unique content related to only a single visual display screen, location is a more general content.

A distal server is in wireless two-way communication with the hand-held information receiving and transmitting device, the distal server capable of receiving, storing and transmitting information from the g award identifier transmitted through the hand-held device or kiosk. That server provides or connects to the economic activity content.

Upon interrogation of the award identifier by the hand-held device or kiosk, the hand-held device or kiosk communicates data received in response from the interrogation of the award identifier to the server, the server containing information in memory that is transmitted to and received by the hand-held device relating to the economic activity and especially the gaming value identified.

The information contained in memory comprising information specific to an economic transaction, purchased article, purchased service, receipt or event available through the hand-held device only after communication has been first established between the hand-held device and the server. The award identifier may, by way of non-limiting examples, be selected from the group consisting of a camera readable QR code, a camera readable bar code, a readable chip, a readable transceiver or a transponder providing a connectable address to interactive program relating to the economic activity. The hand-held device or kiosk is configured to interrogate the award identifier or chip, transceiver or transponder and accept information from the award identifier or chip through near-field communication, and is configured to transmit and receive information to the distal server by wireless communication. The wireless communication between the hand-held device and the distal server is enabled through long-range electromagnetic communication systems, such as where the long-range electromagnetic communication system is a radio frequency communication system.

In one embodiment of the system, visual information at a kiosk is provided in a location visually accessible by a person holding the hand-held device and the award identifier. For example, the visual information may be physically located and available to the user (within a field of vision) at a single monitor at a seating position, from among multiple monitors viewable from a seating position, from a monitor or monitors at a sports arena or stadium (covered or not), in a casino, restaurant, theatre, grocery store, shopping mall, or any other physical location associated with the gaming establishment.

In one example of a method of using the system, the hand-held device may interrogate the interrogatable code, chip, transceiver or transponder on a specific article and receives information from the interrogatable chip, transceiver or transponder in near-field communication or visually captured information; the received information is transmitted top the distal server by wireless transmission and is then stored in memory at the distal server, the received information comprising at least determination of whether gaming value is awarded to the user of the hand-held device for purchasing the specific article.

Alternatively the method may use the system wherein the hand-held device or kiosk interrogates the interrogatable chip, transceiver or transponder on a specific article and receives information from the interrogatable chip, transceiver or transponder in near-field communication or visually captured information; the received information is transmitted top the distal server by wireless transmission and is then stored in memory at the distal server, the received information comprising at least wagering value associated with specific codes and award identifiers used in the system for specific articles or purchases. Where receipts are used for the purchases, a random number generator may be used to associate random amounts of gaming values with purchases at selected locations. Where tags or clips or other elements having opre-entered code are used, those elements have pre-entered data in memory accessible by the server that identifies a fixed amount of wagering value for each code. Again, the hand-held device may communicate by wireless transmission with the distal server and retrieves wagering value information from the distal server, and the distal server possibly provides to the hand-held device, in addition to wagering value information, a menu of additional information available with respect to the specific economic transaction or related economic transaction. The visual information provided may comprise advertising content or product information on which an economic transaction may be effected. Also, in the process, the hand-held device may interrogate the award identifier to access information on potential economic activities related to one field of economic activity related to the gaming environment.

A narrower system within the scope of the [present invention technology obtains and transmits and stores information, including wager value information of an article associated with an award identifier. The information relating to the article may include much of a wide array of information types, including, a generic descriptor of the article type, a specific descriptor of the article type (e.g., manufacturer, trade name, model number, etc.), pricing code (e.g., store code, price identifier), manufacturing date, shelf placement date, and the like.

The system may contain at least: an article intimately associated with an electromagnetically award identifier, such as QR code, bar code, interrogatable chip, transceiver or transponder. The chip may contain permanent (non-erasable) information or may be programmable so that generic chips may be applied to different articles. The chips may be programmed by initial embedding of information, wire transfer of information or wireless transmission to the chip, ASIC or field programmable gated array (FPGA). In a less preferred embodiment of the present invention, the article may have visually readable information (bar codes and the like) that can be recorded by visual, camera-like capture by the hand-held device. The hand-held device would still transmit the captured data to a distal server and would then also receive requested information back from the distal server. U.S. Pat. No. 8,364,552 describes a system and method for using a mobile phone having a camera. The systems and methods receive an image of a merchant access device (e.g., bar code and the like) and optionally location data from a mobile device of a user engaged in the transaction. The systems and methods also receive transaction information associated with the transaction and account information associated with an account of the user.

The hand-held information receiving and transmitting device that can interrogate the chip, the hand-held information receiving and transmitting device comprising an RFID and/or NFC reader to electromagnetically interrogate the chip. The hand-held device incorporating this functionality and the subcomponents necessary for effecting this functionality may be selected from any of the various types of hand-held communication devices operating on any wireless communication network to the server. Such devices, by way of non-limiting examples may include cell phones, smart phones, iPhones, pads, tablets, PDAs and the like.

The server computer may comprise a processor, a computer readable storage medium, and software stored on the computer readable storage medium, the software, when executed by the processor, causes the server computer to perform functions including: receiving, during a transmission from the hand-held device between a consumer and the article from a merchant via a personal hand-held device, merchant access device associated with the merchant, and a merchant wifi system, or wifi system provided by the provider for the hand-held device (which mat capture an image of the merchant access device), the image may include characteristics of the merchant access device located outside of an electronic display of the merchant access device; receiving, during the transmission of information between the consumer and the merchant or server, location data indicating a location of the mobile communication device (and hence the article); identifying the merchant access device from a plurality of merchant access devices associated with the merchant participating in the transmission of information using the characteristics/data/accessible information of the merchant access device located within or outside of an electronic display of the merchant access device included in the received image; wherein identifying the merchant access device includes: comparing the received image with images/information originally sent to (by the hand-held device) or stored in a database to determine a matching image or transmitted and stored information; and comparing the received location data with location data stored in the database to determine a matching location, the database having images and location data associated with merchant access device identifiers; and sending an authorization response message to the merchant access device. The authorization response message may indicate whether or not the information is accurate and is approved.

The chip may contain communicable information relating to the article. A system may comprises one or more user equipment (UEs) (the hand-held device) having connectivity to a communication network. The UEs are any type of mobile terminal, or portable terminal including laptop computers with scanner attachment, handsets, units, devices, multimedia tablets, Internet nodes, communicators, Personal Digital Assistants (PDAs), mobile phones, mobile communication devices, digital camera/camcorders, audio/video players, positioning devices, game devices, and/or the like, or any combination thereof. It is also contemplated that the UEs can support any type of interface to the user (such as "wearable" circuitry, etc.). The UEs permit rapid management, like for example discovery, activation, accessing, modification, and set-up of one or more services, including services, applications, and content, or any combination thereof (referred to herein as "services").

By way of example, the communication network of system includes one or more networks such as a data network (not shown), a wireless network (not shown), a telephony network (not shown), or any combination thereof. It is contemplated that the data network may be any local area network (LAN), metropolitan area network (MAN), wide area network (WAN), the Internet, or any other suitable packet-switched network, such as a commercially owned, proprietary packet-switched network, e.g., a proprietary cable or fiber-optic network. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wireless fidelity (WiFi), satellite, mobile ad-hoc network (MANET), and the like.

The system also includes bearer tags/chips, with each bearer tag corresponding, for example, to one or more services. In exemplary embodiments, the bearer tag is a near field communication (NFC) tag, radio frequency identification (RFID) tag, contactless card, barcode, or any combination thereof that contains information related to the one or more corresponding services related to the article of interest. The service information contained in the bearer tag may include, for instance, one or more service codes to identify the one or more services represented by the bearer tag. It is contemplated that in other embodiments, the bearer tag may contain additional service related information (e.g., expiration date, use restrictions, etc.). The bearer tags, for instance, are embedded in, attached to, or printed on any of a variety of materials capable of supporting the tag (e.g., packaging material, a sticker, a poster, a card, etc.). The UEs each include one or more readers capable of reading the bearer tags, e.g., a near field communication (NFC) reader, radio frequency identification (RFID) reader, contactless card reader, barcode reader, camera, and/or the like, or any combination thereof.

By way of example, NFC, RFID, contactless card, and similar technologies are short-range wireless communication technologies that enable the exchange of data between devices over short distances (e.g., the range for NFC is approximately 4 inches). In general, these technologies comprise two main components, a tag (e.g., attached to an object) and a reader (which can be implemented with the UEs). Communication between the reader and the tags occur wirelessly and may not require a line of sight between the devices. The tag (e.g., an RFID transponder) is, for instance, a small microchip that is attached to an antenna. The tags can vary in sizes, shapes, and forms and can be read through many types of materials.

Moreover, the tags may be passive tags or active tags. Passive tags are generally smaller, lighter, and less expensive than active tags. Passive tags are only activated when with the response range of a reader. The reader emits a low-power radio wave field that is used to power the tag so as to pass on any information that is contained on the chip. Active tags differ in that they incorporate their own power source to transmit rather than reflect radio frequency signals. Accordingly, active tags enable a broader range of functionality like programmable and read/write capabilities.

A distal server is in wireless two-way communication with the hand-held information receiving and transmitting device, the distal server capable of receiving, storing and transmitting information from the chip transmitted through the hand-held device. Upon interrogation of the chip by the hand-held device, the hand-held device communicates data received in response from the interrogation of the chip to the server, the server containing information in memory that is transmitted to and receive by the hand-held device. The information contained in memory may include information specific to the article.

RF techniques are then used to transmit data between the inductors. For example, a digital signal can be modulated by a carrier wave, and then driven through an inductor. The receiving inductor picks up some fraction of this modulated wave, and passes the signal on to a receiver circuit. The use of RF techniques for transmitting data is the reason the inductors are sometimes called "antennae." Many microfabricated antenna designs have been, and continue to be, researched for various applications such as clocking and data transfer. These designs are generally intended for non-test applications and do not meet the cost, performance and data integrity requirements for applications such as SiP testing. The designs presented here create RF transceivers meeting the cost and performance goals of SiP applications. Specialized RF CMOS technologies and other technologies like SiGe are not used for the stated economic reasons, but the concepts may be implemented in these processes for technical reasons. Although many designs may be used for transmitting and receiving data wirelessly, many are not suitable in wafer testing applications since they require a large power budget, or utilize large amounts of silicon real estate on the device under test (DUT) or probe. Additionally, the bit error rate for testing purposes must be extremely low.

The use of RF based interconnects alleviates the need to reduce the number of touch downs on signal i/o (input/output) pads. Further, as has been discussed, KGD levels improve dramatically since a more thorough wafer level test is performed. These two benefits combine to suggest RF based interconnects provide a means for improving SiP process test flow and consequently manufacturing yields.

The method of wireless communication is not limited to inductive coupling, however. It is possible to use other forms of near-field communication, such as capacitive coupling, for communication. As well, far-field communication is also a viable technique, where one antenna receives far-field radiation from a transmitting antenna. Further, optical methods such as lasers, photo diodes, and electro-optic components may be used to couple electronic circuits. Another method involves the use of magnetic systems such as high speed magnetic circuit (MR, GMR, TMR, etc.) components to couple electronic circuits.

One method for improving manufacturing yields is to perform tests of the SiP during the manufacturing process flow. Such testing enables defects to be identified early in the process and rework and repair to be affected or the component can be discarded and reduces the cost of the discard by eliminating additional process steps and their associated additional value. The implementation of a process flow with just one repair step can have a significant impact on manufacturing yield. SiP's are manufactured with materials that are susceptible to probe damage in the same way as CMOS VLSI integrated circuits.

However, wireless access has limitations. One limitation is that there may be a need to provide power to the device being accessed. A limited amount of power can be provided without physical contact to a chip undergoing access, for example, but the amount of power may be inadequate for accessing of complex multicomponent circuits on such a chip. Hence it would be more beneficial to develop a method for accessing electronic components in which the probe can be configured to interface one or both of wireless access and a wireline access methods.

One method to allow physical probing without causing damage is to "ruggedize" the physical contact. For example, use thick metal that will withstand multiple touchdowns or metallurgy that is not compatible with standard manufacturing techniques for integrated circuits but may be applied in a post process. Such metallurgy may include gold contacts, tungsten contacts, etc.

The chip or RFID reader according to U.S. Pat. No. 8,368,515 may include an RF antenna, multiple (e.g., three) antenna connection terminals, a tuning circuit, a memory, a controller, and a secondary battery. The wireless chip or card communicates with an external RFID tag or an RFID reader (e.g., the hand-held device), and stores data into a memory (in the distal server or temporarily in the hand-held device). The RF antenna selectively identifies a radio wave having a frequency (e.g., 13.56 MHz) from among radio waves radiated in the air for RFID communication. In active mode the RF antenna transmits RF communication data to the outside in active mode. The RF antenna is a general loop antenna used for both passive and active mode. The multiple antenna connection terminals are connected to the RF antenna, and are exposed to the outside of the wireless communication card or chip. The multiple antenna connection terminals support both active and passive modes. The multiple antenna connection terminals may be made of a conductive material and are located in parallel to be exposed to a short edge of the wireless communication card or chip. The location of the multiple antenna connection terminals may vary according to the structure of the article and the mode of attachment of the chip to the article.

The tuning circuit may be electrically connected to the multiple antenna connection terminals respectively, and is electrically connected to the RF antenna. A tuning circuit filters a particular frequency (e.g., of 13.56 MHz). The tuning circuit is a general circuit used for RFID communication. Basic data about RFID and diverse data are stored in the memory of the hand-held device (temporarily) or in the distal server. For instance, when the RFID hand-held device is used as a transportable consumer guide information source, detailed data about the generic class of goods, the goods alternatives at that determined location, specific data about individual alternatives, advertisements, warnings, and other information provided about the product by the manufacturer can be sourced from the distal server, and may be stored in the memory of the distal server and displayed transiently on the hand-held device. The memory on the server may be a non-volatile memory such as a flash memory, wherein data stored therein are not erased even when power is not supplied to it.

The hand-held device is electromagnetically connected (in a communication link, as by RFID or near-field communication) to the RF antenna and then by any wireless link to the memory in the distal server. The controller transmits data stored in memory in the outside (distal server) through the RF antenna, or stores data received by the RF antenna in the memory. When the controller is in passive mode, it is operated by currents induced by radio waves emitted from the RFID reader, the hand-held device. When the controller is in active mode, it is operated by power provided by a wireless communication controller set received through the RF antenna. The controller is provided in the form of an integrated circuit (IC) chip. Although a controller may be provided in the embodiment of the present invention, it may not be included in another embodiment of the present invention. In the absence of a controller, the memory may be controlled by a microcontroller unit (MCU) mounted on the wireless communication controller set. In this case, the memory may be connected to the MCU of the wireless communication controller set through the antenna connection terminals.

The secondary battery includes a bare cell, a protection circuit, and two charge/discharge terminals. The secondary battery supplies power to the wireless communication controller set. Although not illustrated, the bare cell is an electrical energy source, and may include an electrode assembly (not shown) and a pouch (not shown) surrounding the electrode assembly (not shown). The electrode assembly may include a first electrode plate (not shown), a second electrode plate (not shown), and a separator (not shown). The electrode assembly may have a form of a plate in which the separator is located between the first electrode plate and the second electrode plate. The electrode assembly is sealed by the pouch (not shown) together with a polymeric electrolyte. Although not illustrated, the bare cell includes a positive electrode terminal and a negative electrode terminal connected to the protection circuit.

Reference to the Figures will further advance enablement and appreciation of the present technology.

FIG. 1 shows a schematic of a system enabling one embodiment of the present invention. The article 3 is shown with the responsive tag 5 on its surface. The responsive tag may be embedded in or adhered to the article 3. The tag 5 may be removable and reprogrammable for reuse. It may be applied to the article 3 by adhesive (permanent if not removable, pressure-sensitive if removable), clips, pins, snaps and the like. The chip/tag 5 is shown as in near-field communication along path A with a hand-held device 7 having a view screen 9. The hand-held device 7 is shown to be in wireless communication along path B with the distal server 11. Each communication path A and B should be two-way communication, although the communication path A between the tag/chip 5 and the hand-held device 7 may be one way, as the chip may need only to be activated or stimulated or charges by the hand-held device, without substantive information being transferred to the chip/tag. A metal tag, with etched code may also be used, with the code (e.g., alphanumerics) may be hand entered into the hand-held device. In such entered or optically readable code, it is best for security purposes to have that code unavailable to a casual user, such as by having the code on an interior surface of a clip firmly attached to an article (with the interior surface hidden from view until the clip is removed and opened for view) or an adhesively secured tag, with the code readable only on the adhesive surface after removal of the tag.

FIG. 2 shows a flow diagram for one method of practicing technology within the scope of the present invention.

Figure 3:
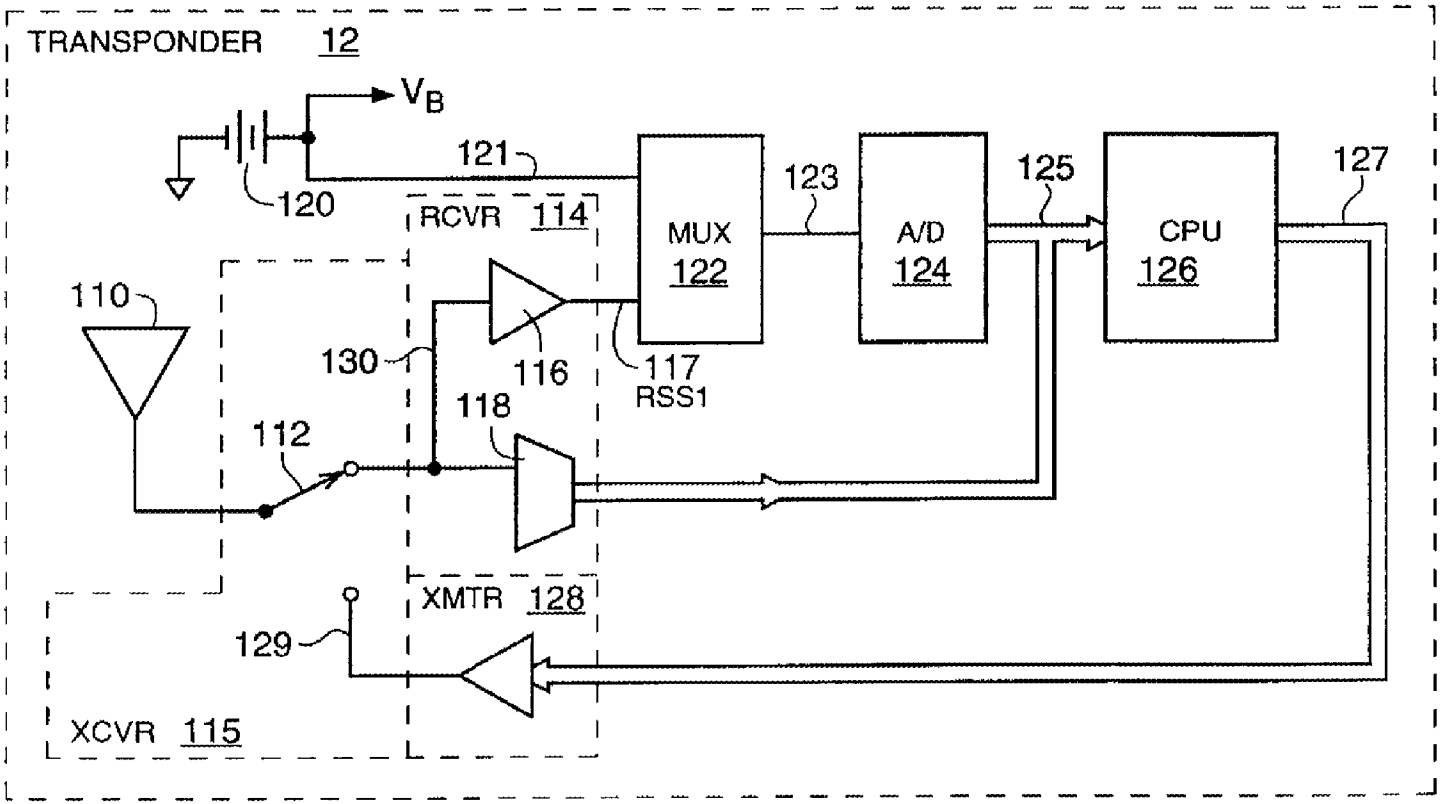
FIG. 3 is a functional block diagram of a transponder that may be used in the present invention, which is described in U.S. Pat. No. 6,487,681.

FIG. 3 is a functional block diagram of a transponder that may be used in the present invention represented in the system of FIG. 1. Transponder 12 includes battery 120, antenna 110, transceiver 115, multiplexer 122, analog to digital (A/D) converter 124, and central processing unit (CPU) 126. Transceiver 115 includes transmit/receive switch 112, receiver 114, and transmitter 128. Transponder 12 operates from battery power provided by battery 120. All functional blocks are coupled to receive battery power signal VB.

The present technology has a wide range of applications and should not be limited by the specific examples provided of fields of use, components and methodology, except as limited by the language of the claims. For example, the system may be used on any receipts or any purchased items or services.

The process may also be used as a using the above identified types of systems where a metal tag or metal-coated tag attached to a purchased article is removed or bent so as to expose code stamped into the metal tag or metal-coated tag. That code is entered (e.g., manually or scanned) into a hand-held interrogation device. That hand-held interrogation device transmits the entered code to the distal server. The distal server then identifies present exhaustion of the use of that code (that is, at least one specific code may be used only once and is then retired, or exhausted) and the server then transmits indication of a wagering value award (or any other comp award) to the hand-held interrogation device.

The invention claimed is:

1. A system for obtaining and transmitting and storing random award-content information on an economic entity associated with a gaming establishment, the system comprising:

an identifier attached to an article;

the article is located and available to a user at a physical location associated with the gaming establishment;

the identifier is intimately associated with an electromagnetically interrogatable code;

the electromagnetic interrogatable code intimately associated with the identifier containing communicable information relating to a random award value;

the identifier is associated with the article in a manner such that the electromagnetic interrogatable code intimately associated with the identifier cannot be identified until packing around the article has been opened or the identifier has been physically removed from the article;

an intermediate system entry device selected from the group consisting of a hand-held information receiving and transmitting device or kiosk information receiving and transmission device that can interrogate the electromagnetic interrogatable code intimately associated with the identifier;

the intermediate entry device comprising a camera, a scanner, RFID reader and/or NFC reader;

the intermediate entry device configured to electromagnetically interrogate the identifier and to transmit the communicable information from the electromagnetic interrogatable code to a distal server;

the distal server is in wireless two-way communication with the intermediate system entry device, the distal server capable of receiving, storing and transmitting the communicable information from the electromagnetic interrogatable code;

the distal server, based upon the communicable information from the electromagnetic interrogatable code, is configured to identify the random award value that is transmitted to and received by the intermediate system entry device, the intermediate entry device, upon receiving the transmitted and received random award value, is configured to enable the random award value to be used for wagering credit in the gaming establishment.

2. The system of claim 1 wherein the electromagnetic interrogatable code intimately associated with the identifier is selected from the group consisting of a visible code, a camera readable QR code, a camera readable bar code, a chip, a transceiver or a transponder providing a connectable address to an interactive program on the distal server relating to the availability of a random value that can be used for wagering credit in the gaming establishment.

3. The system of claim 2 wherein a hand-held device is used as the intermediate system entry device and the hand-held device is configured to interrogate the chip, transceiver or transponder and accept information from the electromagnetic interrogatable code intimately associated with the chip from the chip through near-field communication, and is configured to transmit and receive information to the distal server by wireless communication.

4. The system of claim 3 wherein the wireless communication between the hand-held device and the distal server is enabled through long-range electromagnetic communication systems.

5. The system of claim 4 wherein the long-range electromagnetic communication systems comprises a radio frequency communication system.

6. The system of claim 3 wherein there is visual information provided in a location or position on an article that is visually inaccessible by a person holding the hand-held device and the identifier, such that the identifier cannot be identified until packing around the article has been opened or the identifier has been removed from the article.

7. The system of claim 3 wherein the distal server comprises a host gaming server configured to account for wagering credits at gaming equipment in a gaming environment, and the server transmits, in response to the transmitted and received electromagnetic interrogatable code intimately associated with the article, machine-readable code for display on the hand-held device which can be further interrogated at a gaming device to provide wagering value at that gaming device or in a gaming system in communication with that gaming device.

8. The system of claim 2 wherein there is visual information as the electromagnetic interrogatable code intimately associated with the article provided in a location visually accessible by a person positioning the identifier with respect to the kiosk, and the identifier is associated with an article in a manner such that the identifier cannot be identified until packing around the article has been opened or the identifier has been removed from the article.

9. A method of using the system of claim 8 wherein a hand-held device interrogates a QR code, interrogatable chip, transceiver or transponder on a specific article having the electromagnetic interrogatable code intimately associated with the identifier; and the hand-held device receives information from the QR code, interrogatable chip, transceiver or transponder in near-field communication or as visually captured information;

the hand-held device received information is then transmitted to the distal server by wireless transmission; and the wireless transmitted hand-held device received information is then stored in memory at the distal server, the wireless transmitted hand-held device received information comprising at least a code associated with a gaming value stored in memory in the distal server; and the distal server then enabling use of that gaming value at the gaming establishment by communication from the hand-held device to a gaming device.

10. The method of claim 9 wherein the distal server provides to the hand-held device, in addition to gaming value, a menu of additional visually displayable information available with respect to the specific economic transaction or related economic transactions at the gaming establishment.

11. The method of claim 9 wherein the location comprises an enclosed gaming facility and the identifier is visual information provided in a second location on the identifier visually accessible by a person positioning the identifier with respect to the kiosk, and the identifier is associated with the article in a manner such that the identifier cannot be identified until packing around the article has been opened and the identifier has been removed from the article.

12. The method of claim 11 wherein the article is a physical article and a tag or clip thereon comprises the identifier which identifier is removed from the article to expose and enable interrogation of content on the tag or clip.

13. The method of claim 11 wherein the identifier is a physical receipt for a purchase of an article.

14. The method of claim 8 wherein the hand-held device interrogates the identifier to access information on random gaming value specifically associated with unique identification content on the article from the electromagnetic interrogatable code intimately associated with the article.

15. The system of claim 2 wherein the distal server comprises a host gaming server configured to account for wagering credits at gaming equipment in a gaming environment.

16. The system of claim 15 wherein the intermediate system entry device comprises a kiosk and the kiosk is configured to issue tickets that can be read by gaming devices to indicate available wagering value.

17. The method of claim 16 wherein the visual information provided on a ticket is readable by a gaming device, and the gaming device is configured to accept for wagering purposes the random value indicated on the ticket.

18. A method of using the system of claim 15 wherein a kiosk interrogates a QR code, interrogatable chip, transceiver or transponder on a specific article and receives information from the QR code, interrogatable chip, transceiver or transponder in near-field communication or visually captured information; the received information is then transmitted to the distal server by wireless transmission and is then stored in memory at the distal server, the received information comprising at least a code associated with a gaming value stored in memory in the distal server, the distal server then enabling use of that gaming value by the kiosk printing a machine readable ticket identifying an amount of gaming value available from use of the ticket.

19. A method of using the system of claim 2 wherein a hand-held device received a manually entered code, interrogates a QR code, interrogatable chip, transceiver or transponder on a specific article and receives information from the interrogatable chip, transceiver or transponder in near-field communication or visually captured information; the received information is then transmitted to the distal server by wireless transmission and is then stored in memory at the distal server, the received information comprising at least a code associated with a gaming value stored in memory in the distal server, the distal server then enabling use of that gaming value by communication from the hand-held device to a gaming device.

20. The method of claim 19 wherein the identifier comprises a metal tag or metal-coated tag attached to an article purchased, and the metal tag or metal-coated tag is removed or bent so as to expose code stamped into the metal tag or metal-coated tag, that code is entered into a hand-held interrogation device, that hand-held interrogation device transmits the entered code to the distal server, the distal server then identifies present exhaustion of the use of that code and transmits indication of a wagering value award to the hand-held interrogation device.

* * * * *